US005295379A

United States Patent [19]

Trbovich et al.

[11] Patent Number: 5,295,379

[45] Date of Patent: Mar. 22, 1994

[54] VERTICAL PIERCER MILL

[75] Inventors: Rudy M. Trbovich, Midland; William Rozmus, Pittsburgh; Mario Ricci, Coraopolis, all of Pa.

[73] Assignee: Italimpianti of America, Inc., Coraopolis, Pa.

[21] Appl. No.: 27,109

[22] Filed: Mar. 5, 1993

[51] Int. Cl.[5] ..... B21B 19/04

[52] U.S. Cl. ..... 72/97; 72/95

[58] Field of Search ..... 72/95, 96, 97, 99, 100

[56] References Cited

U.S. PATENT DOCUMENTS

| | | | |
|---|---|---|---|
| 605,027 | 5/1898 | Stiefel . | |
| 618,917 | 2/1899 | Stiefel . | |
| 1,412,730 | 4/1922 | Winters . | |
| 2,025,148 | 12/1935 | Bannister | 80/13 |
| 3,896,652 | 7/1975 | Groos et al. | 72/263 |
| 4,399,680 | 8/1983 | Hartmann et al. | 72/225 |
| 4,442,694 | 4/1984 | Füsser et al. | 72/453 |
| 4,506,531 | 3/1985 | Sakurada et al. | 72/8 |
| 4,538,797 | 9/1985 | Lerch | 269/27 |
| 4,557,130 | 12/1985 | Bond | 72/225 |
| 4,736,612 | 4/1988 | Russell | 72/389 |
| 4,794,776 | 1/1989 | Galletti et al. | 72/235 |
| 4,969,347 | 11/1990 | Matsuo et al. | 72/247 |
| 5,029,400 | 7/1991 | Leclercq et al. | 33/657 |
| 5,142,893 | 9/1992 | Rozmus et al. | 72/95 |

FOREIGN PATENT DOCUMENTS

| | | | |
|---|---|---|---|
| 2124949 | 2/1984 | United Kingdom | 72/95 |

*Primary Examiner*—Lowell A. Larson

*Attorney, Agent, or Firm*—Webb, Burden, Ziesenheim & Webb

[57] ABSTRACT

A vertical piercer/elongator mill includes a mill housing having a base, an open top and an open interior defined by a plurality of vertically extending mill posts and interconnecting side portions. A cylindrically shaped bottom cradle supports a rotatable bottom roll and is fitted in the mill housing through the open top thereof to assume an operable position within the open interior of the housing. A cylindrically shaped top cradle supports a rotatable top roll and is also received within the open interior of the mill housing through the open top of the housing. Vertical adjustment apparatus in the form of screw jacks and balance cylinders are associated with the upper and lower cradles to provide vertical movement of the cradles within the mill housing to establish a selected rolling gorge. Hydraulically actuated feed angle adjustment devices are associated with the top and bottom cradles and mill housing to provide controlled rotative movement of the top and bottom cradles about a vertical axis to establish a selected feed angle between the top and bottom rolls. Hydraulic clamps are also associated with the mill housing to fixedly secure the top and bottom roll cradles within the open interior of the mill housing. Motorized guide shoes are provided on the mill housing on opposite sides of the pass line and permit quick guide shoe changes. The mill housing further includes an adjustable bar steadier to provide support for a piercer bar during startup and for subsequent shell support. A spindle support apparatus is also provided for ease in roll spindle coupling.

21 Claims, 18 Drawing Sheets

VERTICAL PIERCER MILL

BACKGROUND OF THE INVENTION

The present invention relates generally to rolling mills. More particularly, the invention concerns rolling mills for piercing solid billet as well as for elongating the pierced shell in the manufacture of seamless pipe and tube.

Piercing of solid billet for the production of seamless tubes is well-known in the art, dating back over the past 100 years. For example, U.S. Pat. No. 618,917 to Stiefel discloses a piercing mill having two conically shaped rolls oriented in a horizontal position and U.S. Pat. No. 2,025,148 to Bannister discloses a piercing mill having two conically shaped rolls oriented in a vertical position, that is, one work roll positioned above the other.

Heretofore, when different diameter product is to be rolled in a conventional piercer or elongator, a substantial amount of mill downtime is required in order to make the necessary changes in the roll spacing, roll feed angles and/or to change the rolls themselves. Substantial time is also required for changing of guide shoes in conventional piercer mills. It is also commonplace in the prior art to dedicate a particular mill as a piercing mill and a second mill as an elongator mill.

The problems of prior art piercing mills involving excessive downtime for roll gorge adjustment and/or for feed angle adjustment are solved by the present invention. In addition, the present invention provides a vertical piercing mill or elongator mill in which roll changes can be made with a minimum of lost production time and manpower. The invention also provides means for quickly changing worn stationary guide shoes or guide discs.

Still further, the present invention provides a cone type piercer or elongator mill of compact and economical design in which the conventional mill cap and associated equipment are eliminated. Thus, the present invention reduces downtime significantly over prior art piercing/elongator mills so as to maximize production efficiency while concurrently reducing capital expense for the mill itself and its installation.

SUMMARY OF THE INVENTION

Briefly stated, the vertical piercer/elongator mill of the present invention comprises a mill housing having a base, an open top and an open interior defined by a plurality of vertically extending mill posts and interconnecting side portions. A cylindrically shaped bottom cradle supports a rotatable bottom roll therein. The bottom cradle is inserted in the mill housing through the open top thereof to assume an operable position within the open interior of the housing. A cylindrically shaped top cradle supports a rotatable top roll and is also received within the open interior of the mill housing through the open top of the housing. Vertical adjustment means in the form of screw jacks and balance cylinders are associated with the upper and lower cradles to provide vertical movement of the cradles within the mill housing to establish a selected rolling gorge between the top and bottom rolls along a horizontally extending pass line defined therebetween. Hydraulically actuated feed angle adjustment means are associated with the top and bottom cradles and mill housing to provide controlled rotative movement of the top and bottom cradles about a vertical axis to establish a selected feed angle between the top and bottom rolls.

Hydraulic clamping means are also associated with the mill housing to fixedly secure the top and bottom cradles and the respective rolls within the open interior of the mill housing after the selected rolling gorge and feed angle are established.

A pair of motorized guide shoe drive assemblies are provided on the mill housing, one on each side of the pass line. Each drive assembly includes a guide shoe holder having a pair of guide shoes positioned at opposed ends thereof. A motor driven arm supports the guide shoe holder and pivotally moves the holder to an operable position such that one of the pair of guide shoes on each arm engages the rotating tubular shell being formed between the rolls. Once positioned, the guide shoe holders are rigidly clamped in place by hydraulic cylinders. Each support arm is adapted to be selectively withdrawn to a spaced position from the mill whereupon the shoe holder is rotated 180° such that a new guide shoe faces the pass line. The support arm is returned to the operable position and clamped in place. After the shoe holder is clamped into position, the used guide shoe is removed from the holder and a new guide shoe is inserted in its place.

The improved mill of the present invention also includes a piercer bar support apparatus which provides close support of the piercer bar during the start of the piercing operation. The bar support apparatus is affixed to the mill housing on the exit side of the mill intermediate the two roll spindles. The bar support apparatus includes three rolls spaced equi-distance from the longitudinal axis of the piercer bar wherein each roller is radially adjusted simultaneously by a hydraulic cylinder and linkages that position the rolls for proper bar position and pierced shell position.

The mill also includes retractable spindle supports to lift and position the roll spindles for easy disengagement of the roll spindle coupling during roll changing operations.

DETAILED DESCRIPTION

Figure 1:
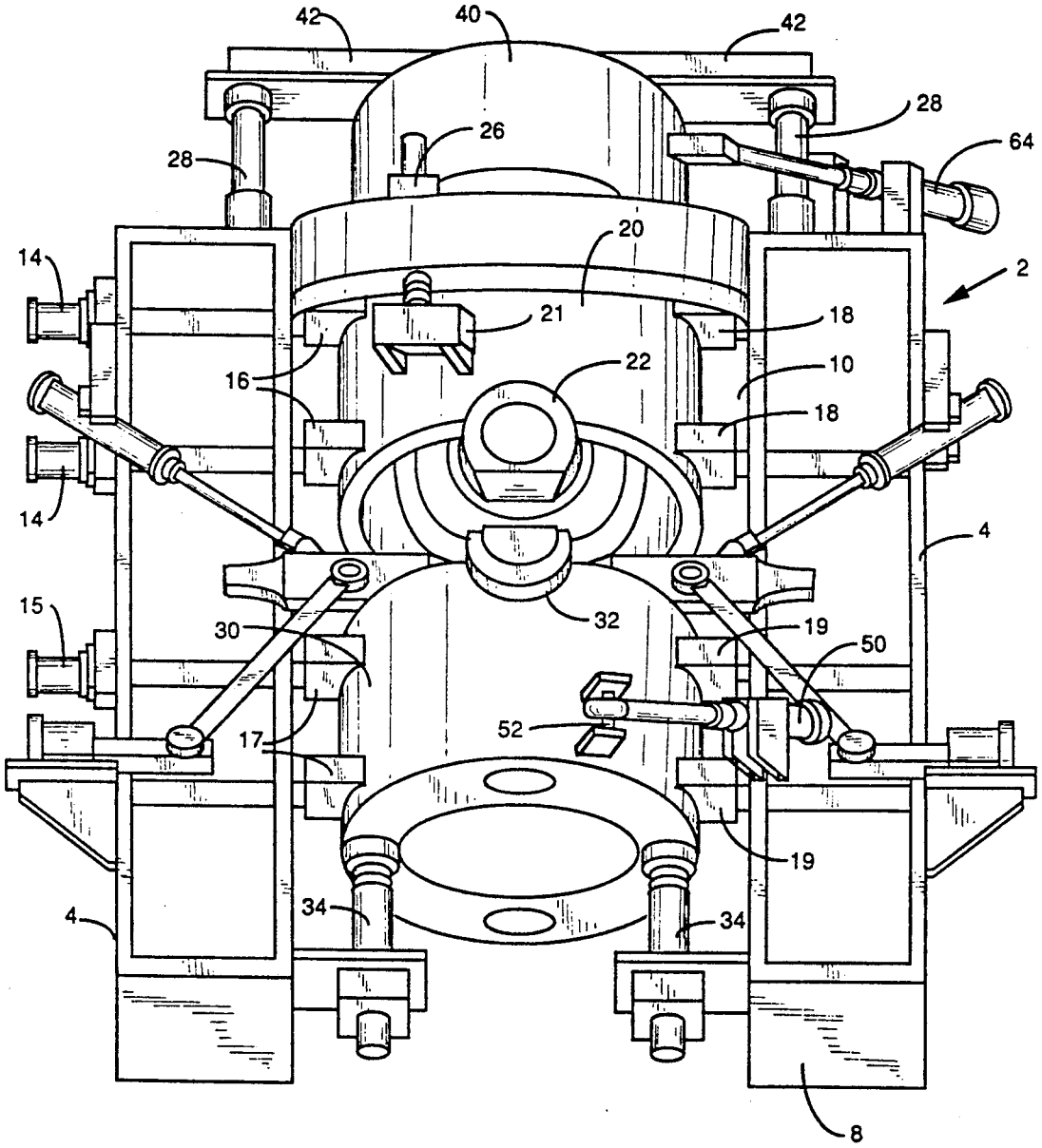
FIG. 1 is a perspective view of the mill of the present invention in simplified form taken from the entry side of the mill.

With reference to the drawings, identical reference numbers are used throughout the various views to identify like elements. FIG. 1 represents a simplified, perspective view of a vertical piercer mill of the present invention, identified generally by the reference numeral 2. The vertical piercer mill 2 comprises a mill housing 4 which preferably is of a steel fabricated construction.

Figure 2A:
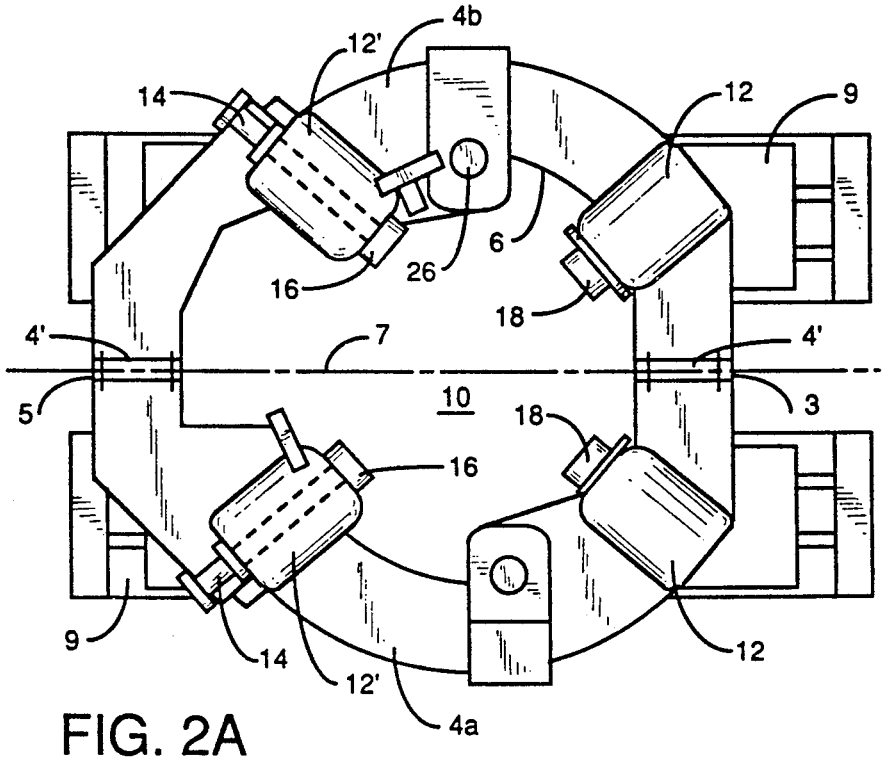
FIG. 2*a* is a top plan view of the mill housing of the invention without the roll cradles installed.
Figure 2B:
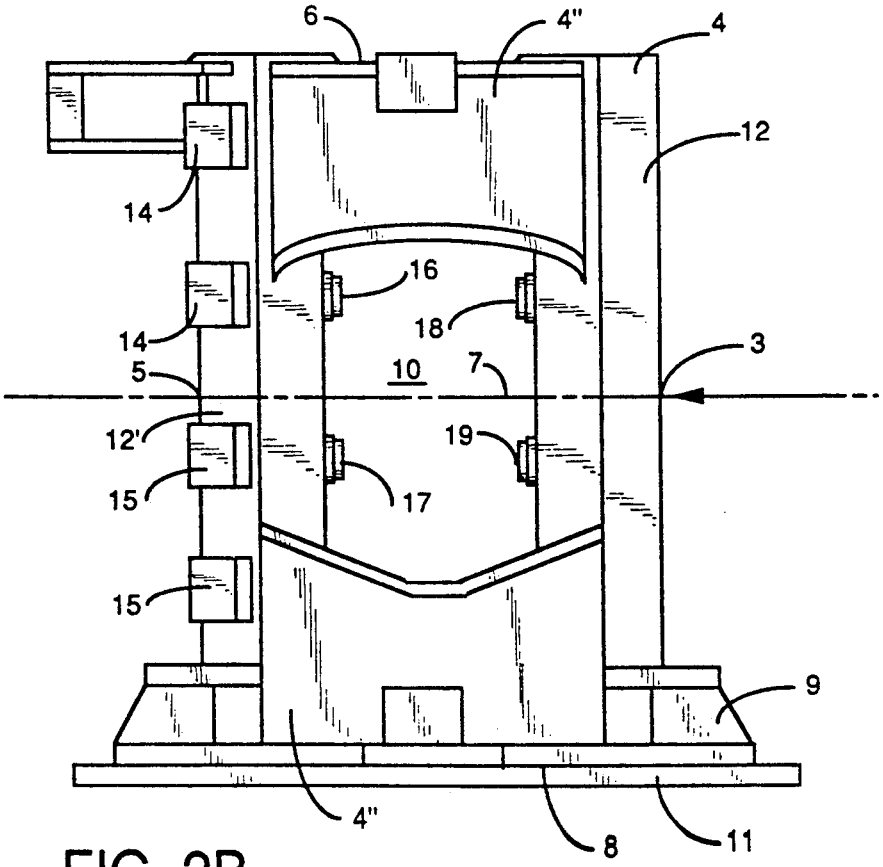
FIG. 2*b* is a side elevation view of the mill housing of FIG. 2*a;*
Figure 4:
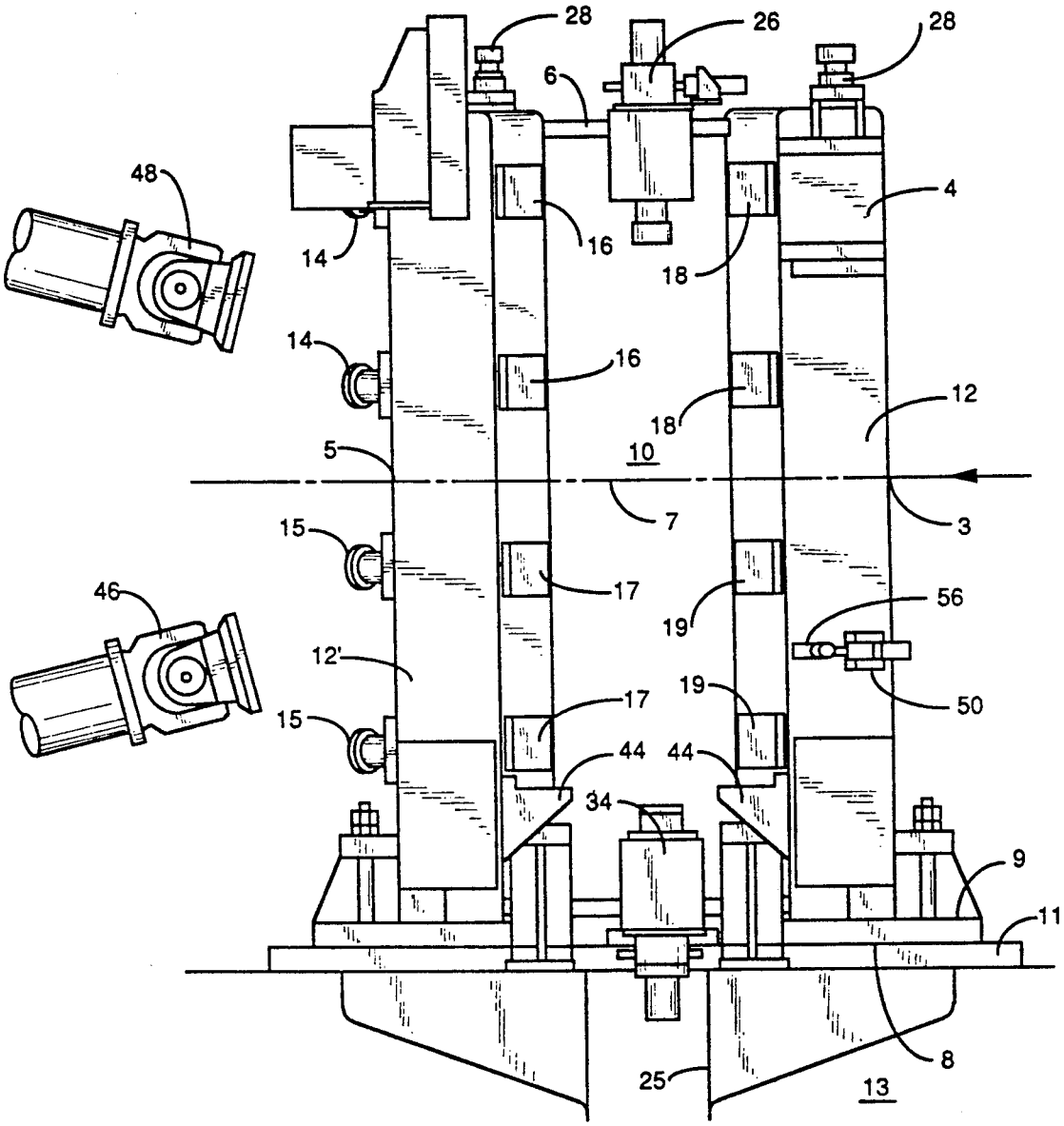
FIG. 4 is a side elevation view of the mill housing showing a portion of the foundation floor and a fragmented view of the roll spindles in a retracted position.

With reference to FIGS. 2A, 2B and 4, the mill housing 4 includes an entry side 3, an exit or spindle side 5, an open top 6 and a base 8. The base 8 of the mill housing 4 includes outwardly extending feet 9 which are preferably bolted to a base plate or soil plate 11 as best seen in FIG. 4. The base plate 11 is seated on an appropriate foundation 13 having a drain opening 25 formed therein to permit drainage of cooling fluids and mill scale therein. The mill housing 4 includes four mill posts 12, 12' which traverse the vertical height of the mill 2, which is on the order of about twenty feet. The mill housing 4 has an open interior 10 which extends from the top 6 to the base 8. In the various drawing views, the pass line of the work rolls of the mill 2 is identified by reference numeral 7 and extends from the entry side 3 where the solid billet enters the mill 2 to the exit or spindle side 5 where the pierced, tubular shell leaves the mill.

One pair of the mill posts 12' has a plurality of hydraulically actuated cylinders 14 and 15 positioned therethrough with moveable clamp heads 16 and 17, respectively, motivated thereby. The opposed pair of housing posts 12 has a plurality of stationary cradle rests 18 and 19 positioned thereon whose function will be explained in greater detail hereinafter.

As seen in FIG. 2A, the mill housing 4 is preferably constructed of two steel halves 4*a* and 4*b* bolted together at joints 4'. The joints are made at the base and at the top of the mill housing 4, at the entry side 3 and at the spindle side 5. Each mill housing half 4*a* and 4*b* contain two of the mill posts 12 and 12'. The two mill posts 12 and 12' on each housing half 4*a* and 4*b* are integrally joined at the top and bottom by steel arch segments 4", FIG. 2B.

It will be appreciated by those skilled in the art that the mill housing 4 contains no conventional mill cap as commonly required in prior art mills since all of the functions of the mill cap are integrated into the housing 4.

Figure 3B:
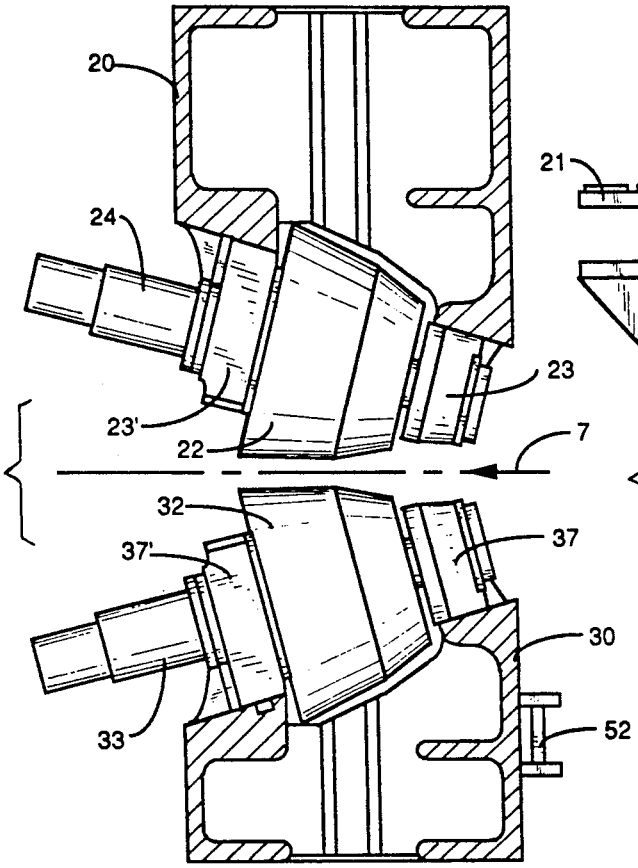
FIG. 3*b* is a side elevation, partial crosssectional view of the top and bottom roll cradles and rolls of FIG. 3*a;*
Figure 3A:
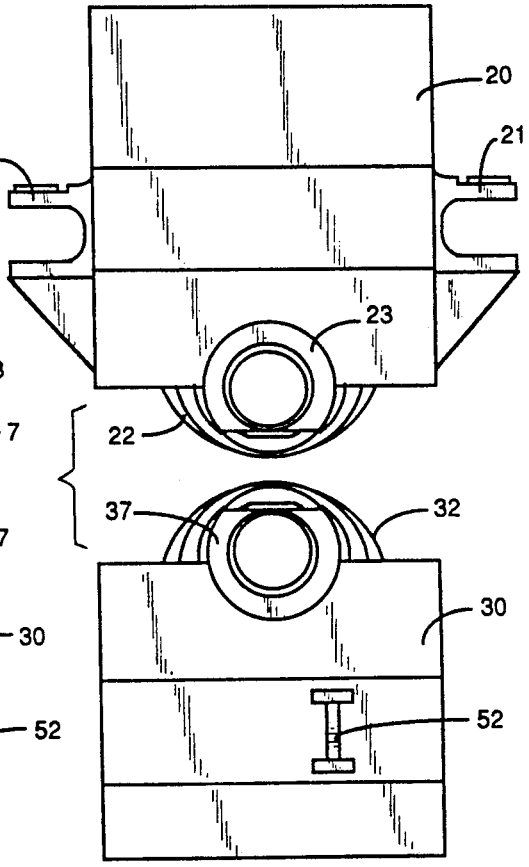
FIG. 3*a* is a front end elevation view of the upper and lower roll cradles and rolls viewed from the entry end of the mill.

A significant feature of the mill housing 4 resides in the open top 6 and open interior 10 which permits rapid installation and removal of the top and bottom roll cradles 20 and 30. The roll cradles 20 and 30 depicted in FIGS. 3A and 3B are made of steel and are generally cylindrical in shape. The cradles support the piercer rolls 22 and 32 at a pre-set toe angle relative to the horizontal pass line 7 of the mill. A pre-set toe angle of 15° is one presently preferred toe angle for the piercing mill 2.

The bottom roll cradle 30 has a pair of spaced yokes 37 and 37' into which are journaled the front and rear shafts of the bottom roll 32. An outwardly extending roll shaft 33 is attached to the bottom roll. The top roll cradle 20, likewise, carries a pair of spaced apart yokes 23 and 23' which rotatably support the roll 22 by way of appropriate bearings. The top roll 22, likewise, carries a rearwardly extending roll shaft 24. The top roll cradle 20 also has a pair of outwardly extending, wing-like cradle ledges 21 radially extending therefrom whose function will be explained in greater detail hereinafter.

The work rolls 22 and 32 are preferably cone shaped and capable of providing piercing expansion ratios over a wide range, on the order of 5% to 25% billet expansion. The mill 2 is also capable of piercing a wide variety of steel grades, including carbon, mid-grade and high alloy grade steel billet. The cone shaped rolls 22 and 32 each include a divergent rear section which permit the production of a seamless tube having a high degree of concentricity and wall uniformity, minimum internal defects, and excellent outer surface quality.

Figure 5:
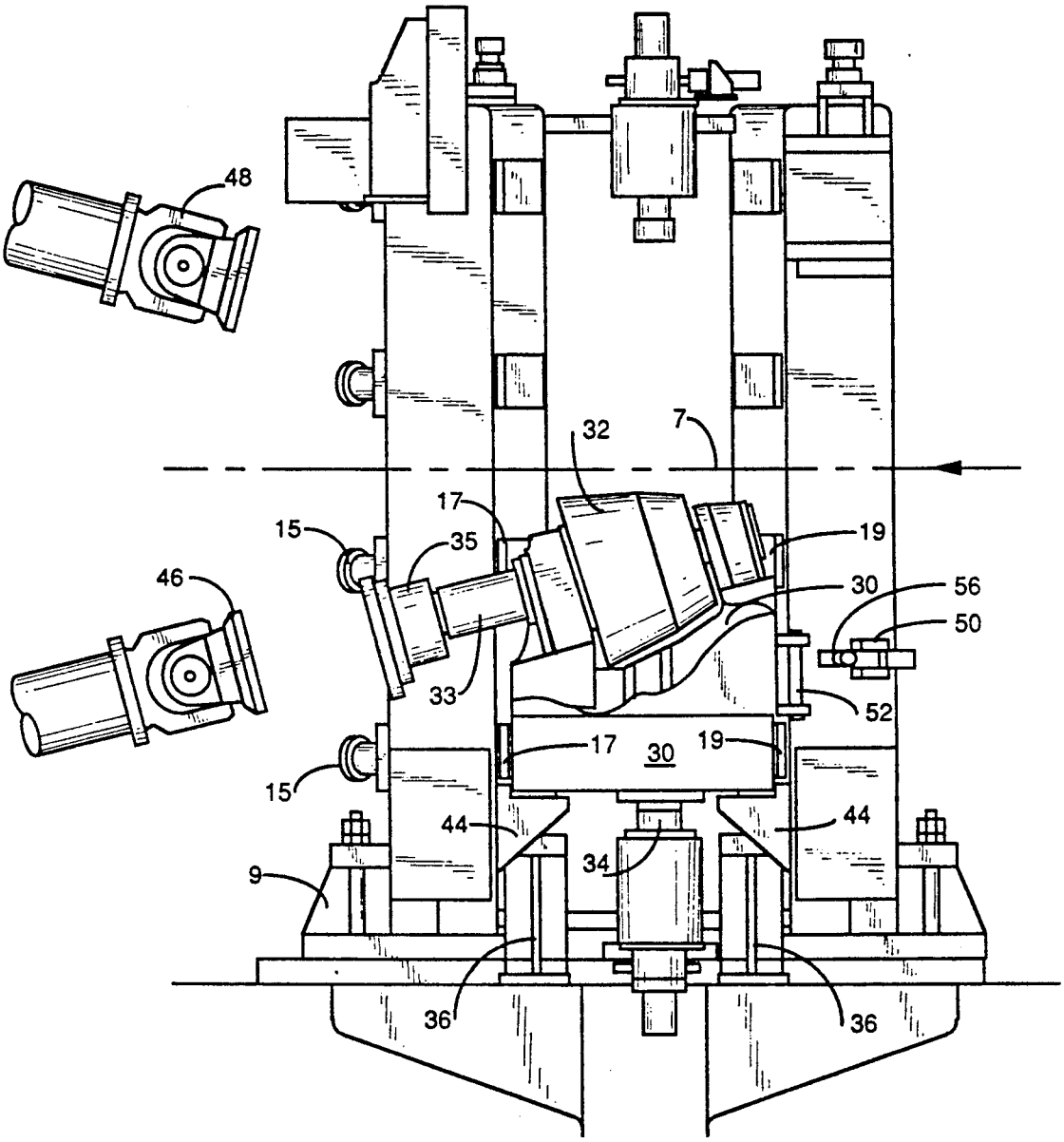
FIG. 5 is a partially fragmented side elevation view of the mill housing similar to FIG. 4 showing the bottom roll cradle and bottom roll positioned in the housing.

In order to prepare the mill 2 for operation, the upper and lower cradle clamps 14 and 15 are moved to a retracted position in the empty mill housing, FIG. 4. The bottom cradle 30, with the bottom roll 32 in place therein, is lowered into the open interior 10 of the mill housing 4 through the open top 6 thereof. A conventional, overhead crane may be used to perform the cradle installation. The bottom roll cradle 30 is lowered into the mill housing 4 until the cradle comes to rest against a plurality of stops 44. The stops 44 are rigid steel members which outwardly project from the mill posts 12, 12' of the mill housing 4. After the bottom cradle 30 comes to rest against the stops 44, a feed angle adjustment latch member 56 is moved by a hydraulically actuated cylinder 54, shown in FIG. 6, to engage a vertically extending rotation bar 52. The bar 52 is rigidly attached to the sidewall of the bottom cradle 30, FIG. 5.

Figure 7:
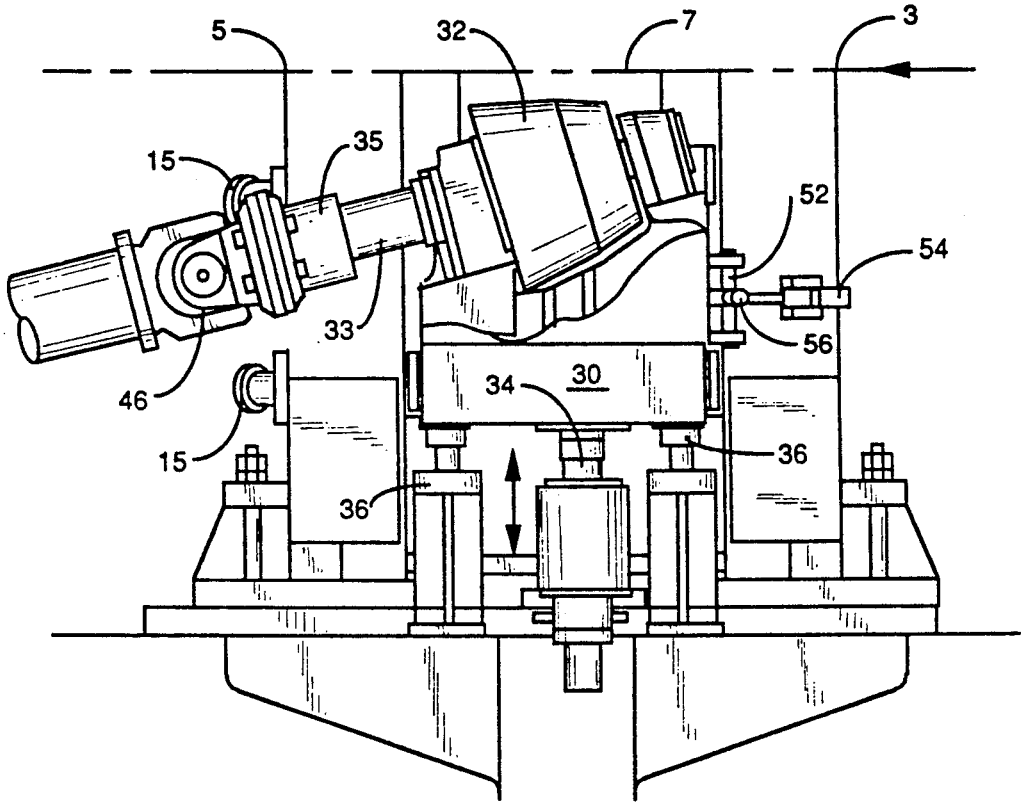
FIG. 7 is a partial side elevation view of the lower half of the mill housing with the bottom roll cradle in a raised position and the bottom roll spindle assembled.

A bottom roll drive spindle 46 is then moved into position, as shown in FIG. 7, and boltably secured to a hub 35 carried by the lower roll shaft 33. The bottom roll gorge height and bottom roll feed angle are adjusted to selected positions after the bottom roll spindle 46 is secured to the bottom roll. As previously described, the bottom cradle 30 initially rests against the stops 44. The bottom cradle 30 is then raised by a pair of motorized mill jack screws 34 which vertically move the roll cradle 30 to a desired height relative to the pass line 7 to establish a selected roll gorge. A pair of hydraulically actuated balancing cylinders 36, each circumferentially oriented 90° from the pair of mill screws 34, are also actuated and forcibly bear against the lower end of the cradle 30 to assist the mill screws 34 in raising the bottom cradle to a selected elevation for gorge adjustment purposes. The cylinders 36 ensure that the plane defined by the lower end of the roll cradle 30 is in a horizontal alignment. The motorized mill screws 34 move in a calibrated manner to ensure that the bottom roll 32 is accurately spaced from the pass line 7 at a selected distance. Thus, very accurate and repeatable roll gorge settings for the mill are obtainable.

Figure 6:
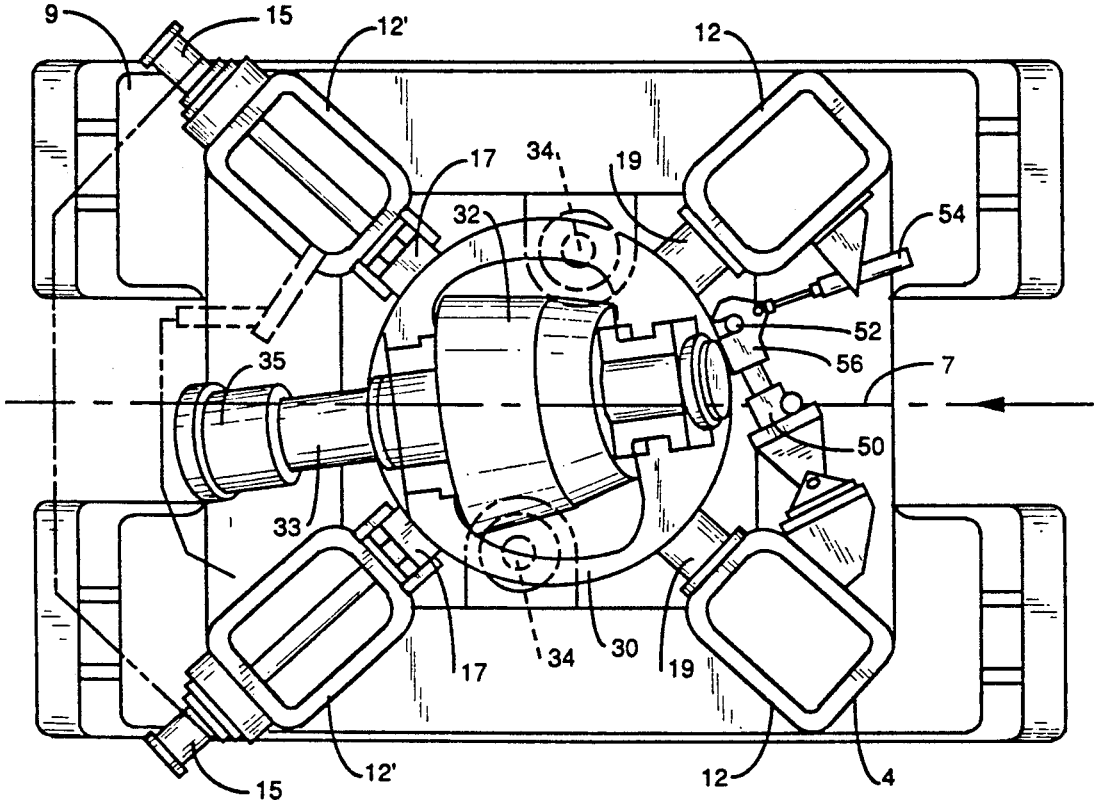
FIG. 6 is a top plan view of the mill housing and bottom roll cradle of FIG. 5 showing the feed angle adjustment means.

A desired feed angle for the bottom roll 32 is established by controlled movement of a motorized jack screw 50 mounted on the mill housing 4. The jack screw 50 moves the latch hook 56 and the coupled rotation bar 52 to cause rotation of the bottom cradle 30. The hydraulic cylinder 54 causes the latch hook 56 to forcibly bear against the rotation bar 52 to ensure tight engagement between the two elements. As best seen in FIG. 6, movement of the jack screw 50 causes the bottom cradle 30 and attached roll 32 to rotate about a vertical axis and move relative to the pass line 7 to the desired feed angle, defined by the angular relationship between the axis of rotation of the roll and the pass line.

As seen in FIG. 7, the rotation bar 52 has an extended vertical dimension which permits the latch member 56 to travel vertically upwardly or downwardly therealong so as to permit feed angle adjustment at various cradle elevations. In this regard, the rotation bar 52 has a vertical length at least as great as the maximum vertical displacement of the bottom cradle 30 so as to ensure engagement by the feed angle adjustment latch member 56 thereon.

After the proper bottom roll gorge elevation is established by movement of the mill screws 34 and balance cylinders 36 and after the proper feed angle has been established, the bottom cradle 30 is clamped into place by activation of the four bottom hydraulically actuated clamping cylinders 15. Activation of the two spaced apart pairs of bottom cylinders 15 causes the respective clamp heads 17 carried thereby to engage the sidewall of the bottom cradle 30, thus urging the cradle into tight engagement against the two spaced pairs of opposed stationary bottom cradle rests 19, see also FIG. 13.

Figure 8:
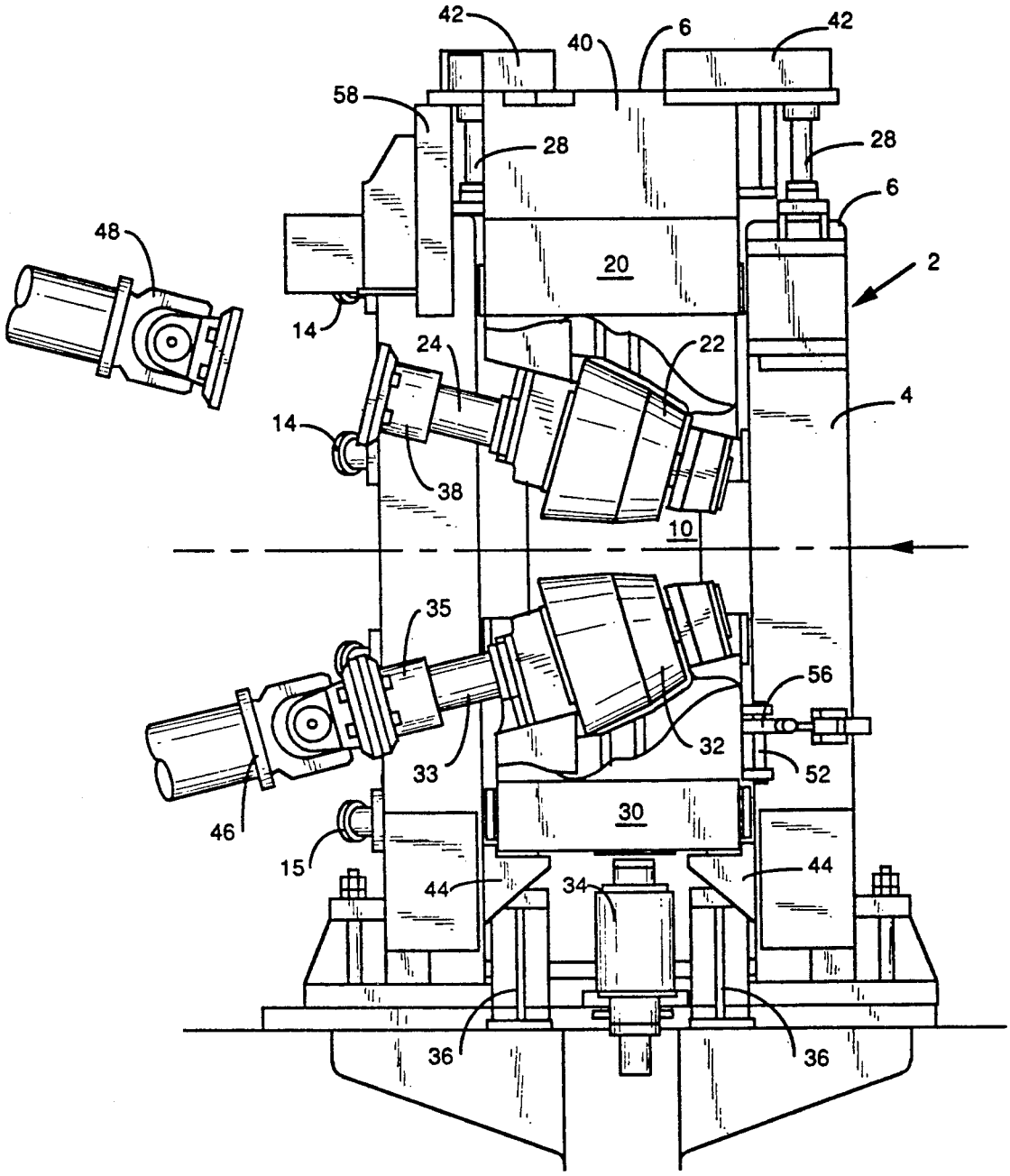
FIG. 8 is a partially fragmented side elevation view of the mill housing with top and bottom roll cradles positioned therein showing the bottom roll spindle assembled and the top roll spindle detached.

After the bottom cradle 30 and bottom roll 32 have been placed within the mill housing 4, the top cradle 20 and top roll 22 are installed. The top cradle 20 is lowered through the open top 6 of the mill housing 4 to an initial position within the open interior 10, see FIGS. 2A, 8 and 9. The top cradle 20 has a cylindrically shaped cradle extension segment 40 bolted or otherwise secured to the upper end thereof, see FIG. 13. The cradle extension segment 40 preferably has three balance wings 42 extending radially outward therefrom and spaced approximately 120° apart. The balance wings 42 are beam-like structural elements fabricated from steel plate which support the weight of the top cradle and roll during installation. The top cradle 20, including the integral cradle extension segment 40 and balance wings 42, is lowered into the open interior 10 of the mill housing 4 by overhead crane. During the insertion operation, the spindle connecting hub 38 of the roll shaft 24 is located in an initial orientation shown in FIG. 9. That orientation is required so that the roll shaft 24 and hub connection 38 have adequate clearance, as well as to permit the pair of outwardly extending cradle ledges 21 to clear the mill housing posts 12 and 12' and mill jack screws 26 as the cradle is lowered into the mill housing 4.

Figure 9:
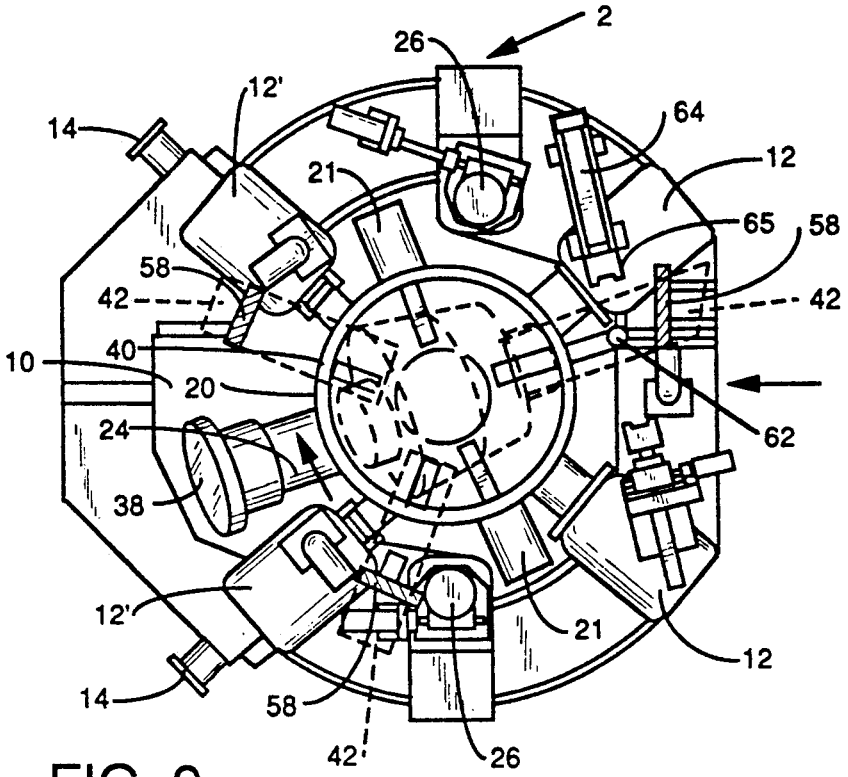
FIG. 9 is a plan view of the top of the mill housing showing the top cradle in an entry position.
Figure 10:
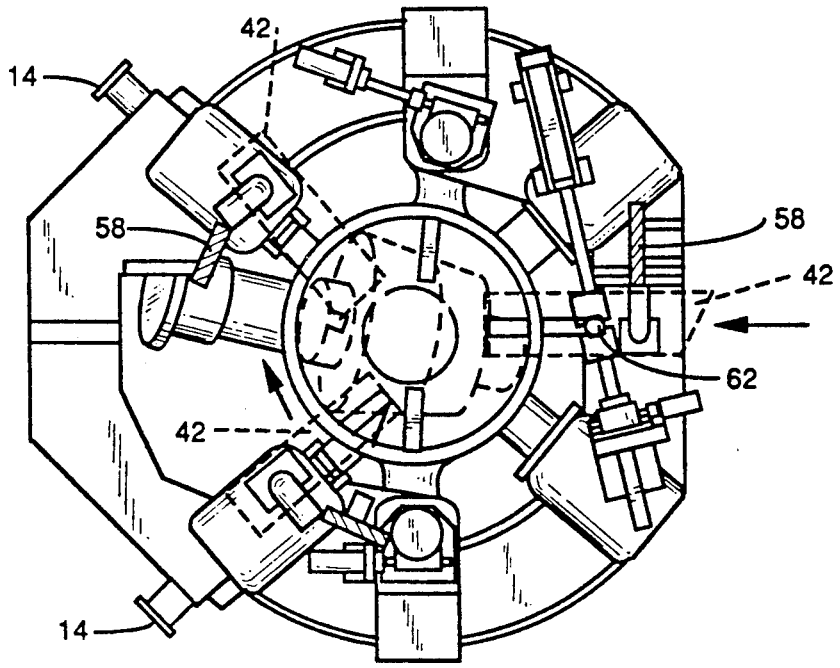
FIG. 10 is a plan view similar to FIG. 9 wherein the top cradle has been rotated clockwise to an operable position.
Figure 12:
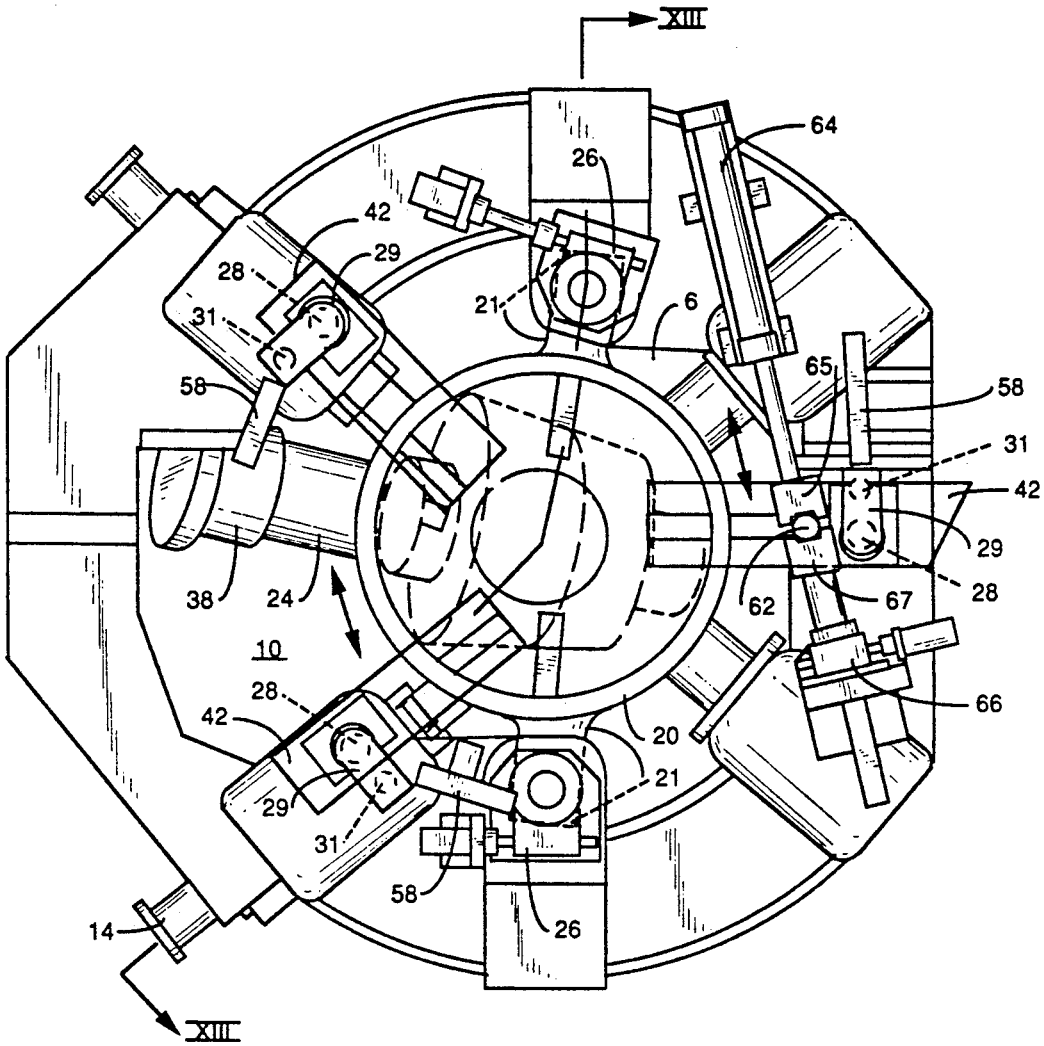
FIG. 12 is an enlarged plan view of the mill housing similar to FIG. 10, showing the feed angle adjustment means in greater detail.

The top cradle 20 is lowered in this initial orientation until the three outwardly extending cradle wings 42 bear against a respective wing stop 58. The three wing stops 58 are constructed of steel plates which upwardly extend from the top 6 of the mill housing 4, FIGS. 8 and 9. After the top cradle 20 is positioned on the stops 58, the cradle 20 is rotated clockwise about 27° into an operable position shown in FIG. 10. The cradle rotation is rotated by a hydraulically actuated ram 64 and a motorized jack screw unit 66. FIGS. 9, 10 and 12 depict the rotation sequence from the initial cradle insertion position to the operable position. As best seen in the enlarged view of FIG. 12, an elongated rotation bar 62 carried by the top cradle 20 is engaged by a pusher block 65 which, in turn, is moved by the hydraulic cylinder 64. The action of the moving pusher block 65 against the rotation bar 62 causes the top cradle 20 and top roll 22 to rotate in a clockwise direction until the pusher bar 62 impinges against an opposed, stopped pusher block 67 carried by the motorized jack screw 66. The pusher block 67 of the motorized jack screw 66 is moved to a predetermined stop position which then accurately establishes a desired top feed angle. Thus, the top cradle 20 rotates under the influence of pusher block 65 and the hydraulic cylinder 64 until the rotation bar 62 impinges against the pre-set, stopped pusher block 67 of the jack screw 66, at which point a predetermined feed angle for the top roll 22 is established.

Figure 11:
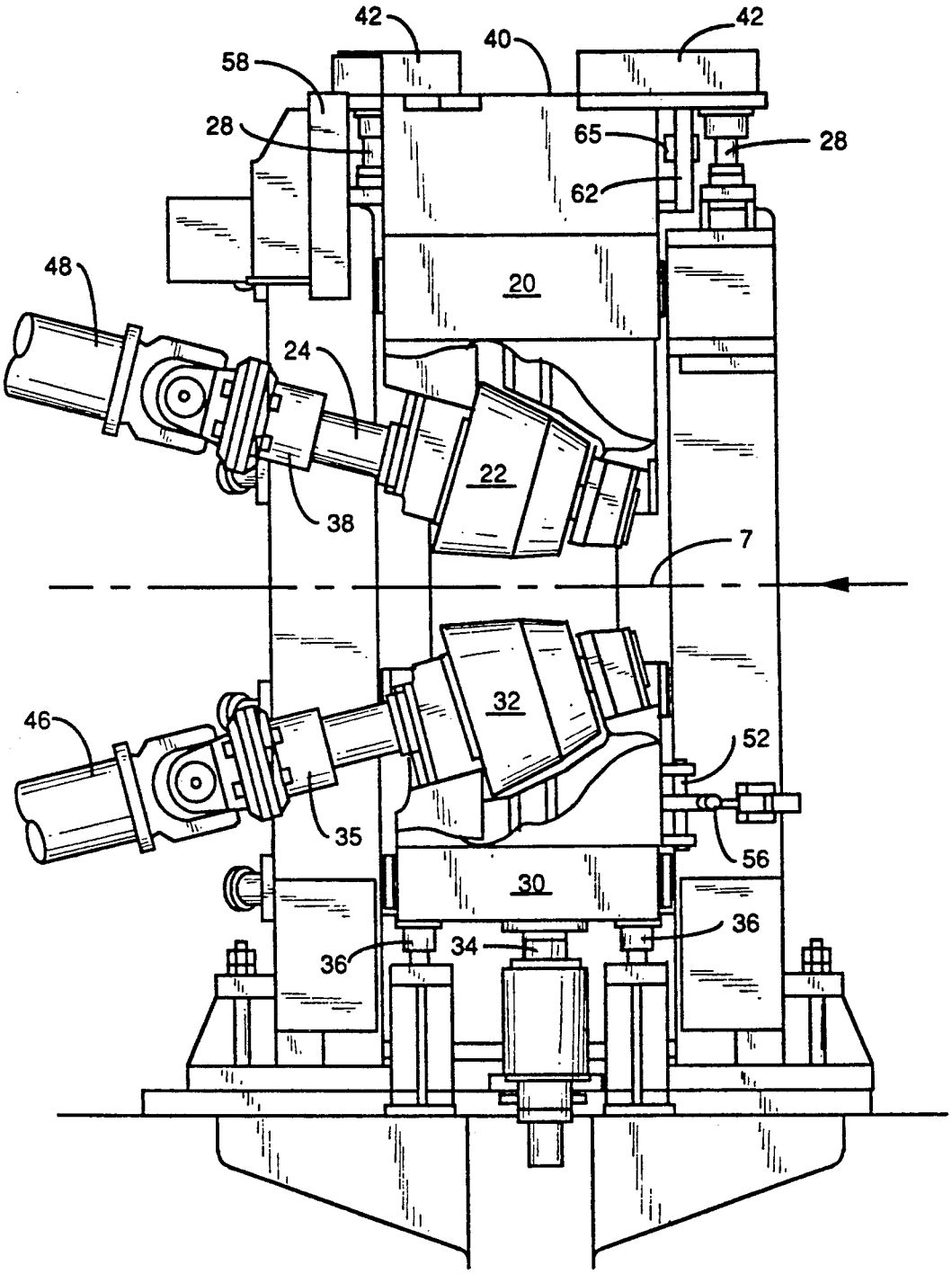
FIG. 11 is a partially fragmented side elevation view of the mill housing depicting the top and bottom roll cradles with the respective spindles fully assembled.

It will also be appreciated that as the top cradle. 20 is rotated, the three outwardly extending, integral cradle wings 42 slidably move off of the fixed cradle wing stops 58 to a new position atop three bearing members 29 carried by each of the three top balance cylinders 28. The bearing members 29 are rectangularly shaped in plan view and are adapted to support the weight of the respective cradle rings 42 when the cradle 20 is rotated from the initial position on the fixed stops 58 to the operable position atop the balance cylinders 28, as shown in the rotation sequence depicted in FIGS. 9, 10 and 12. The balance cylinders 28 then lower the cradle wings 42 to an elevation slightly below the stops 58, FIG. 11. In order to prevent tipping or caulking of the bearing surface 29 and binding of the moveable piston rod portion of balance cylinder 28, a parallel guide rod 31 is preferably positioned at a distal end of each of the bearing members 29, FIG. 12.

The roll gorge is adjusted for the top roll 22 after the top roll drive spindle 48 is attached to the hub 38 of the roll shaft 24. The pair of motor driven mill screws 26 are lowered from a retracted position to a preselected extended position corresponding to a desired roll gorge dimension. A lifting force is then transmitted to the three cradle wings 42 by activation of the top balance cylinders 28. The top cradle 20 is raised by the balance cylinders 28 until the two outwardly extending cradle ledges 21 engage the lower ends of the motorized mill screws 26, FIG. 13. Any clearances which may exist between the mill screws 26 and the cradle ledges 21 are removed by the balance cylinders 28 since the top cradle is held tight against the mill screws 26 by virtue of the force exerted by the three balance cylinders.

Figure 13:
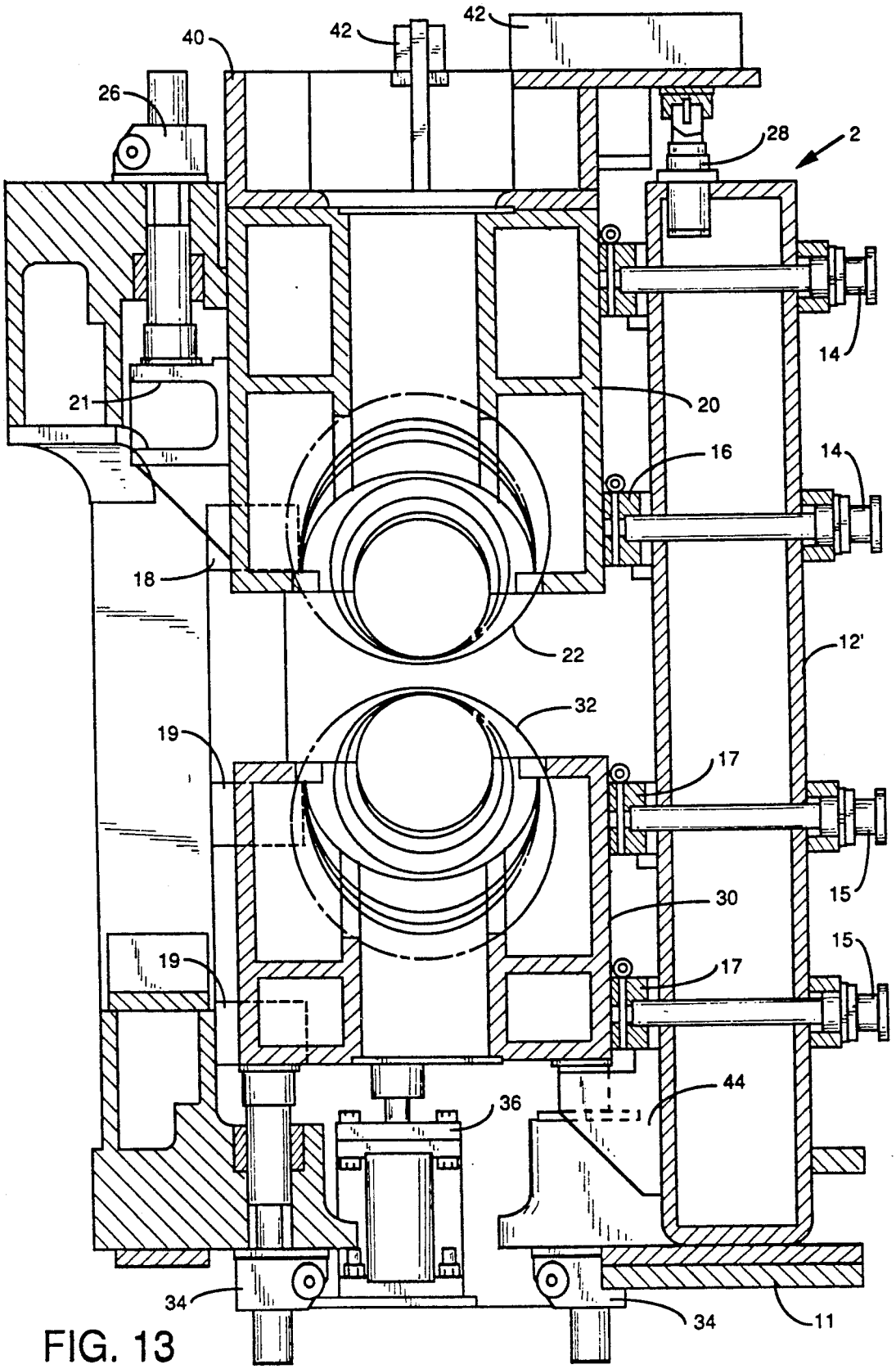
FIG. 13 is a cross-sectional front elevation view of the mill housing and roll cradles viewed from the entry end of the mill.

The horizontally actuated top hydraulic cradle clamps 16, driven by the hydraulic cylinders 14, hold the top cradle 20 rigidly in place against the opposed top cradle rests 18, see FIG. 13 in the same manner as previously described in connection with the bottom cradle.

In the event roll gorge or feed angle adjustments are required during operation, the reverse procedure is utilized. Namely, the hydraulic clamping force of the top and bottom hydraulic cylinders 14 and 15 is relaxed for feed angle changes, gorge adjustment or cradle removal purposes.

Figure 14:
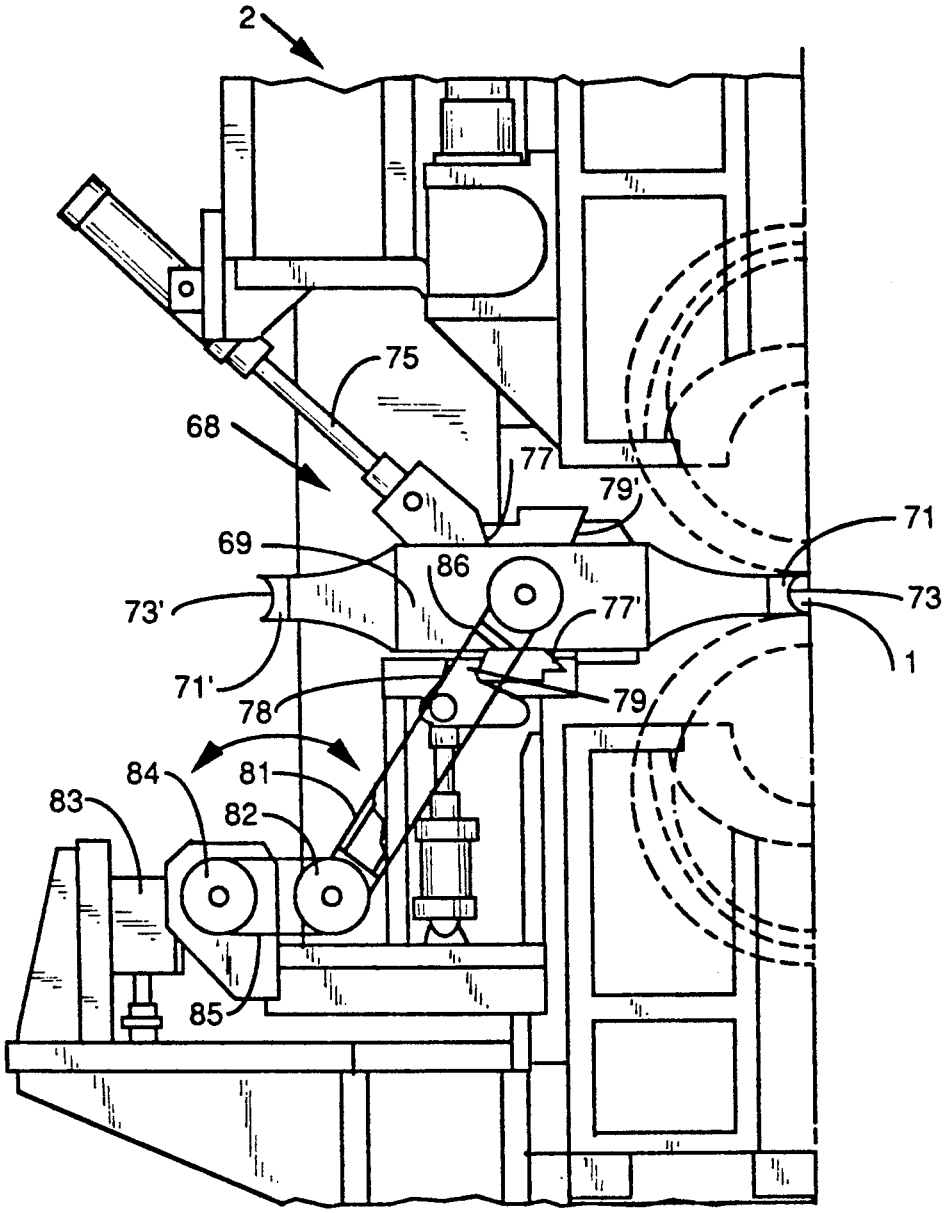
FIG. 14 is a partial front elevation view of one half of the rolling mill of the invention showing the details of the guide shoe holder mechanism.
Figure 15:
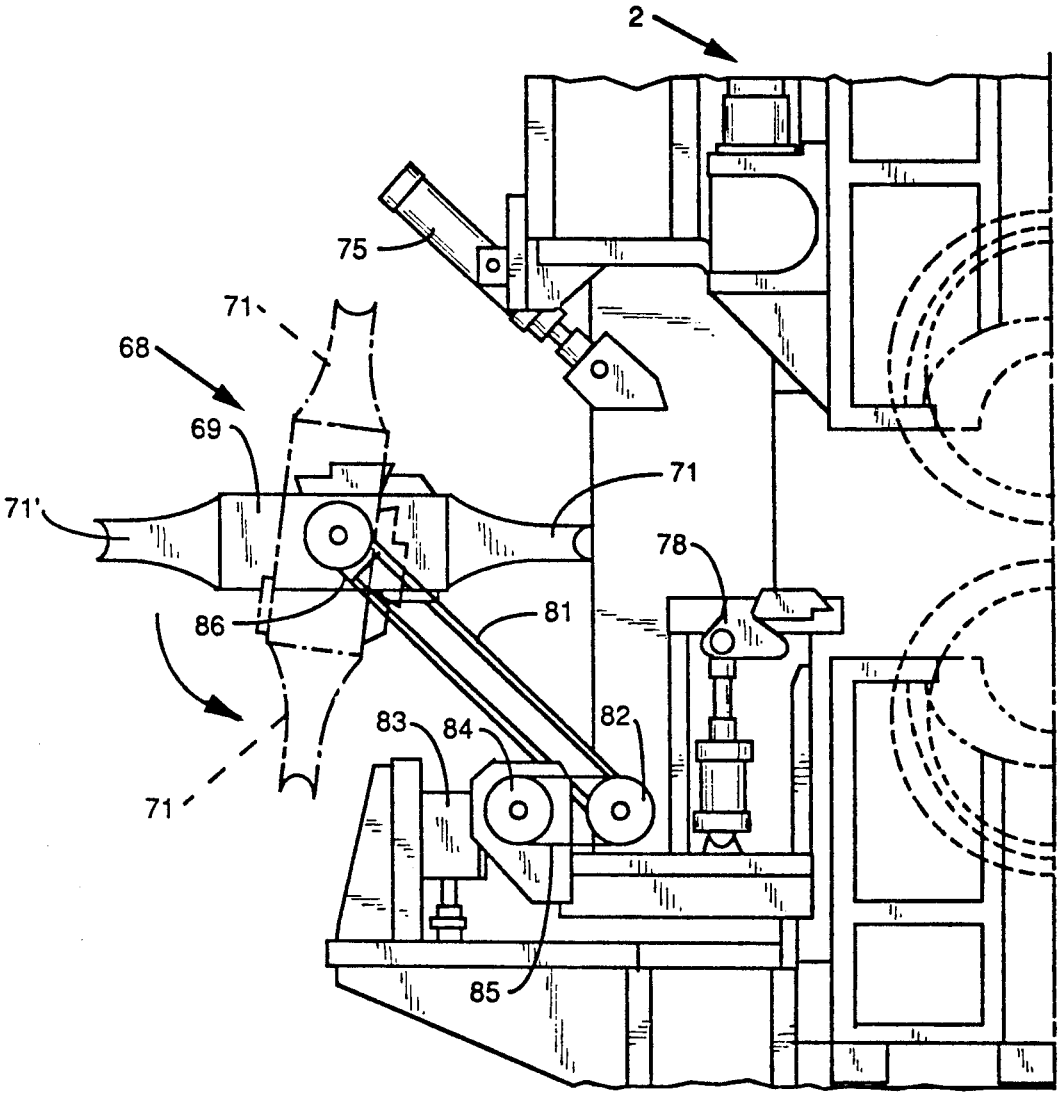
FIG. 15 depicts the guide shoe holder mechanism of FIG. 14 showing the mechanism in a retracted position and the guide shoe holder being rotated in phantom lines.

The mill 2 of the present invention includes a novel guide shoe mechanism generally designated 68 in FIGS. 14 and 15. A guide shoe holder 69 in the form of a metal tool holder carries a pair of steel guide shoes 71 and 71' at opposed ends thereof. Each of the guide shoes 71 and 71' includes a shaped concave surface 73, 73' which are adapted, individually, to closely engage a rotating cylindrical bar or shell workpiece 1 between the top and bottom rolls along the pass line of the mill. After some period of operation, the concave surface 73 of the guide shoe 71 becomes worn and it is necessary to halt the piercing operation and change the worn guide shoe. Of course, it is understood that a similar guide shoe engages the workpiece 1 on the opposite side of the mill and that guide shoe also requires periodic changing after it becomes worn. In order to minimize the downtime required to change a worn guide shoe, the guide shoe mechanism 68 includes a hydraulically actuated upper clamping mechanism 75 which engages a cam surface 77 formed on the upper surface of the guide shoe holder 69. A hydraulically actuated lower clamp mechanism 78 engages a second cam surface 79 formed on the lower surface of the guide shoe holder 69. An arm assembly 81 is pivotally attached at first end 86 to the shoe holder 69 and pivotally coupled at second end 82 to a drive motor 83. The motor 83 turns a toothed wheel 84 and an engaged chain drive 85 to rotate a toothed drive wheel carried by the second end 82 of the arm 81. As seen in FIG. 15, the pivot arm 81 is moved away from the mill 2 after the upper and lower clamps 75 and 78 have been withdrawn from the shoe holder 69. The guide shoe holder 69 is then rotated 180° about pivot connection 86 carried by the arm 81 to permit the movement of a new guide shoe 71' toward the mill and the worn shoe 71 away from the mill in the position previously occupied by the new guide shoe. The new guide shoe 71' is then moved by way of the arm 81 into an operable position close to the pass line and the clamps 75, 78 are moved into a locking position. The previously worn guide shoe 71 can then be replaced while the mill is in operation, thus permitting the next guide shoe change to be made with a minimum of downtime. It will be further seen in FIG. 14 that the guide shoe holder 69 contains beveled or wedge shaped locking surfaces 77 and 79' on one face and similar locking surfaces 79 and 77' on its opposite surface to accommodate the wedging/clamping action of the upper and lower clamping devices 75 and 78 after the shoe holder 69 has been rotated 180°.

Figure 16:
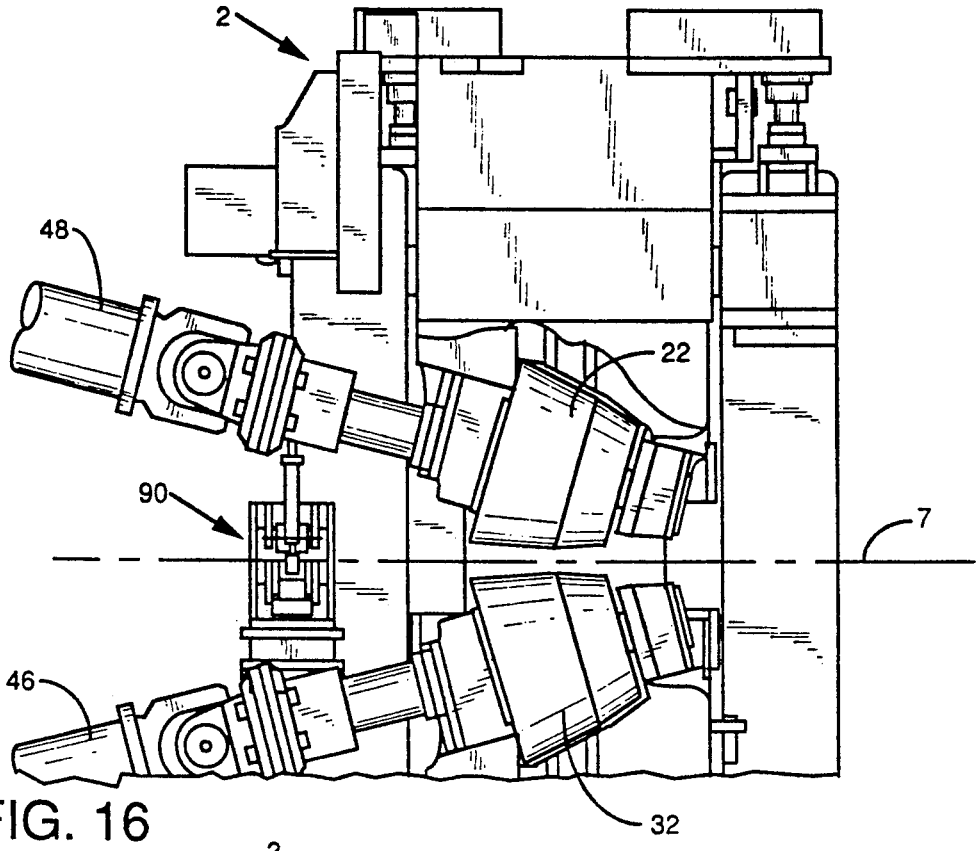
FIG. 16 is a partially fragmented side elevation view of the mill showing a piercer bar support roller assembly at the exit end.
Figure 17:
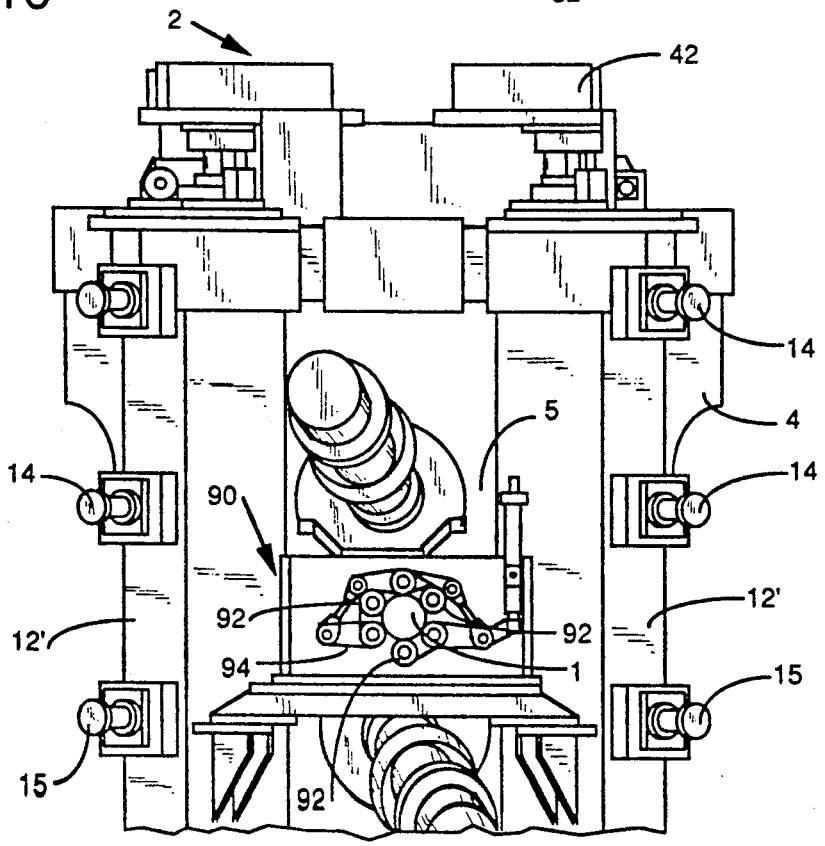
FIG. 17 is a rear side elevation view taken from the exit end of the mill showing the piercer bar support roller assembly of FIG. 16.

In the piercing operation, a preheated, solid metal billet is pierced between the top and bottom rolls 22, 32. The rolls force the solid billet over a piercing point carried on the end of a mandrel bar. The billet is rotated by the mill rolls 22, 32 as it moves over the piercing point of the mandrel and it is necessary to support the mandrel bar for rotation with the billet. In addition, a large compressive load is exerted on the rotating mandrel bar during the piercing operation. In order to rotatably support the mandrel bar and prevent it from buckling and vibrating under these high compressive loads, the mandrel bar and pierced shell are rotatably supported in the mandrel bar support mechanism 90 depicted in FIGS. 16 and 17. The mandrel bar support mechanism 90 is similar to the guide device disclosed in commonly owned U.S. Pat. No. 3,101,015. Mechanism 90 consists of a plurality of roller elements 92 which rotatably engage the pierced shell and/or mandrel bar 1 therebetween. Moveable linkages 94 allow the roller elements 92 to move radially in a coincidental manner about the pass line 7 to accommodate various bar or shell diameters therebetween. A plurality of such mandrel bar support mechanisms 90 may be situated in a spaced apart array along the outlet table 96 in the mill layout depicted in FIGS. 19 and 20. The bar support mechanism 90 depicted in FIGS. 16 and 17 is attached directly to the housing posts 12' at the spindle end 5 of the mill to provide mandrel bar support in close proximity to the working rolls.

Figure 18:
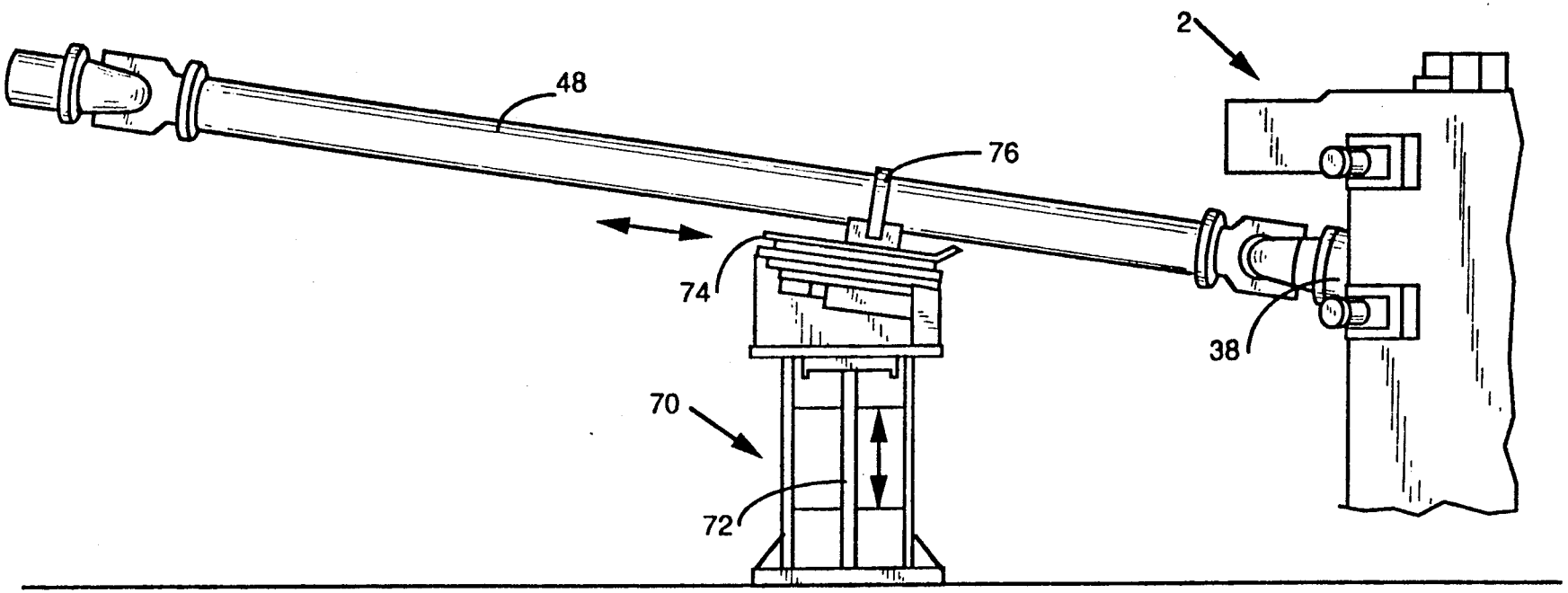
FIG. 18 is a side elevation view of a top spindle support mechanism for use in the present invention.
Figure 19:
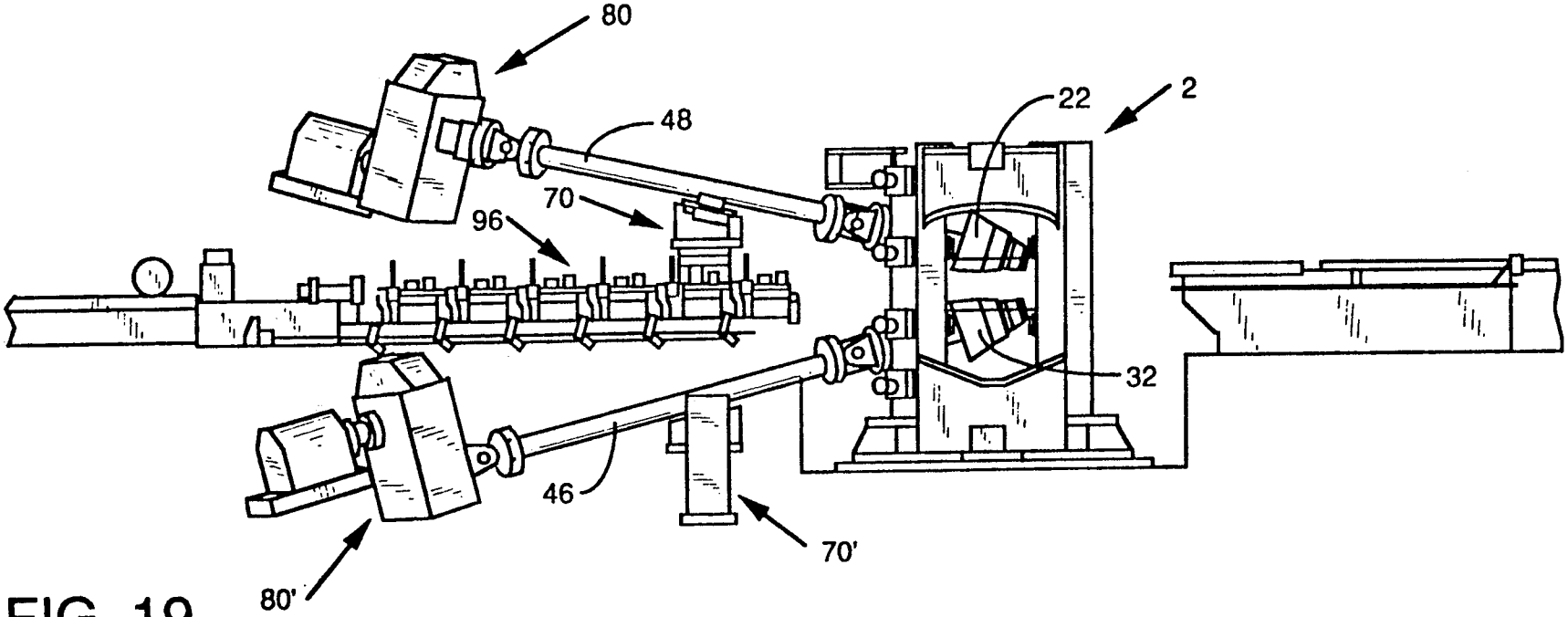
FIG. 19 is a side elevation view showing the general arrangement of the mill of the invention including the top and bottom spindle support mechanisms.
Figure 20:
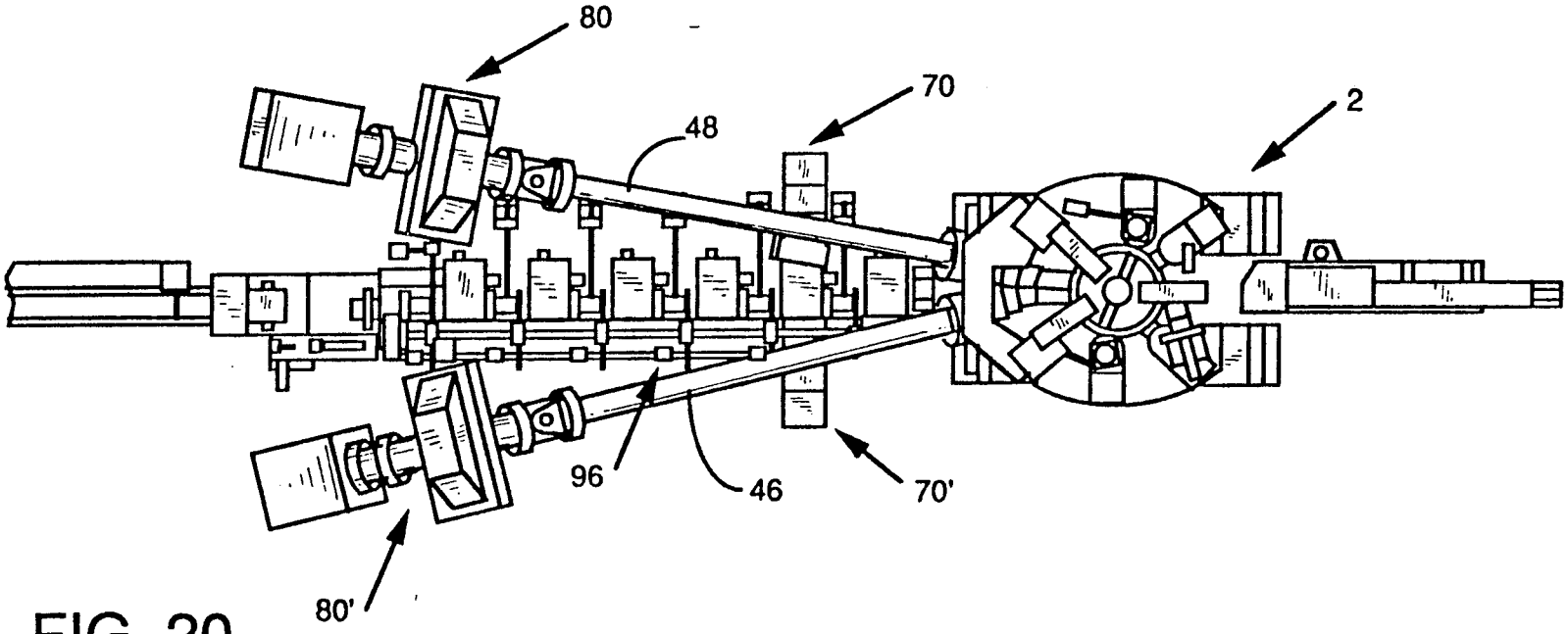
FIG. 20 is a plan view of the general mill arrangement depicted in FIG. 19.

The top and bottom drive spindles 48 and 46, respectively, are disconnected and moved toward and away from the mill 2 whenever roll changing or maintenance is required. Spindle movement is accomplished by way of a spindle manipulation device 70 depicted in FIG. 18. The spindle manipulation device 70 is moveable in two axes by virtue of a vertically moveable hydraulic lift 72 and a laterally moveable hydraulic table 74. The table 74 includes a strap member 76, which grippingly engages the spindle 48. The spindle 48 is raised and lowered by movement of the hydraulic lift 72 and moved into engagement with the roll hub 38, or withdrawn therefrom, by selective movement of the hydraulically actuated table 74. One end of the spindle 48 is coupled to a motorized drive 80, as shown in FIGS. 19 and 20. A motorized drive 80' powers the bottom spindle 46 which also has a spindle manipulation device 70' associated therewith.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A vertical piercer/elongator mill for the manufacture of seamless tubing, comprising:

a mill housing having an open interior and an open top, defined by a plurality of vertically extending mill posts;

a bottom roll cradle having a bottom roll rotatably supported therein, said bottom roll cradle adapted to be operably positioned within the interior of the mill housing through the open top thereof;

a top roll cradle having a top roll rotatably supported therein, said top roll cradle adapted to be operably positioned within the interior of the mill housing through the open top thereof;

feed angle adjustment means associated with the mill housing and the top and bottom roll cradles for rotatively moving the roll cradles to establish a selected feed angle between the top and bottom rolls;

roll gorge adjustment means associated with the mill housing and the top and bottom roll cradles for vertically moving the roll cradles to establish a selected roll gorge spacing between the top and bottom rolls; and clamping means associated with the mill housing to fixedly secure said top and bottom roll cradles within the mill housing when the selected feed angle and roll spacing have been established.

2. The mill of claim 1 further including a pair of guide shoe means positioned on opposed sides of the top and bottom rolls adjacent a pass line defined by said rolls and adapted to support a rotating workpiece along said pass line, each of said guide shoe means including a pivotal support arm mounted on the mill housing carrying a rotatable guide shoe holder at one end thereof, each guide shoe holder having first and second guide shoes detachably mounted at opposed ends thereof, each of said support arms adapted to pivotally move toward said pass line into an operable position, wherein the first of said guide shoes supports the workpiece and adapted to pivotally move away from said pass line in a maintenance position, whereby the guide shoe holder is rotated 180° to place the second guide shoe in an operable position facing the pass line and to permit replacement of the first guide shoe.

3. The mill of claim further including bar support means attached to the mill housing on an exit end of said mill housing adapted to rotatably support a mandrel bar and pierced shell exiting said mill.

4. The mill of claim 1 wherein the top and bottom rolls are conical in shape.

5. The mill of claim 1 wherein the feed angle adjustment means includes a rotation bar affixed to each of the roll cradles, and respective pusher means to engage each of the rotation bars to permit selective rotation of each of the roll cradles and rolls about a vertical axis.

6. The mill of claim 5 wherein each of the respective pusher means includes a motorized jack screw stop and an opposed hydraulically actuated pusher bar, wherein the desired feed angle is determined by a position of the motorized jack screw stop and said hydraulically actuated pusher bar is adapted to move the rotation bar of the roll cradle to the position established by motorized jack screw stop.

7. The mill of claim 1 wherein the roll gorge adjustment means comprises bottom roll cradle height adjustment means and top roll cradle height adjustment means, said bottom roll cradle height adjustment means including a pair of spaced apart motorized mill jack screws positioned on a lower portion of the mill housing adapted to engage said bottom roll cradle and vertically move the said bottom roll cradle to a selected height, and further including a pair of hydraulically actuated bottom balancing cylinders to engage and assist in moving the bottom roll cradle;

said top roll cradle height adjustment means including a pair of motorized mill jack screws vertically moveable to a selected height for engagement with the top roll cradle to establish the roll spacing, and a plurality of hydraulically actuated top balance cylinders adapted to engage the top roll cradle and for lifting the top roll cradle to the selected height established by the mill jack screws.

8. The mill of claim 7 wherein the top roll cradle further includes a pair of cradle ledges radially extending on opposed sides of said top roll cradle adapted to engage the mill jack screws, and further including a plurality of outwardly extending cradle wings affixed at an upper end of said top roll cradle for engagement with the top balance cylinder.

9. The mill of claim 1 including top and bottom drive spindles for driving the top and bottom rolls, respectively, said mill further including a spindle manipulation device associated with each of the drive spindles, said spindle manipulation device including means for detachably gripping said respective spindle and means for moving said spindle in a vertical direction and in a horizontal direction toward and away from said mill to permit attachment and detachment of the respective drive spindles to the top and bottom rolls.

10. A vertical piercer/elongator mill for the manufacture of seamless tubing, comprising:

a mill housing having an open interior and an open top, defined by a plurality of vertically extending mill posts;

a bottom roll cradle having a bottom roll rotatably supported therein, said bottom roll cradle adapted to be operably positioned within the interior of the mill housing through the open top thereof;

a top roll cradle having a top roll rotatably supported therein, said top roll cradle adapted to be operably positioned within the interior of the mill housing through the open top thereof;

feed angle adjustment means associated with the mill housing and the top and bottom roll cradles for rotatively moving the roll cradles to establish a selected feed angle between the top and bottom rolls;

roll gorge adjustment means associated with the mill housing and the top and bottom roll cradles for vertically moving the roll cradles to establish a selected roll gorge spacing between the top and bottom rolls;

clamping means associated with the mill housing to fixedly secure said top and bottom roll cradles within the mill housing when the selected feed angle and roll spacing have been established; and guide shoe means positioned on opposed sides of the rolls to support a rotating workpiece along a pass line defined by said rolls.

11. The mill of claim 10 wherein each of the guide shoe means includes a pivotal support arm mounted on the mill housing carrying a rotatable guide shoe holder at one end thereof, each guide shoe holder having first and second guide shoes detachably mounted at opposed ends thereof, each of said support arms adapted to pivotally move toward said pass line into an operable position, wherein the first of said guide shoes supports the workpiece and adapted to pivotally move away from said pass line in a maintenance position, whereby the guide shoe holder is rotated 180° to place the second guide shoe in an operable position facing the pass line and to permit replacement of the first guide shoe.

12. The mill of claim 10 further including bar support means attached to the mill housing on an exit end of said mill housing adapted to rotatably support a mandrel bar and pierced shell exiting said mill.

13. A vertical piercer/elongator mill for the manufacture of seamless tubing, comprising:

a mill housing having an open interior and an open top, defined by a plurality of vertically extending mill posts;

a bottom roll cradle having a bottom roll rotatably supported therein, said bottom roll cradle adapted to be operably positioned within the interior of the mill housing through the open top thereof;

a top roll cradle having a top roll rotatably supported therein, said top roll cradle adapted to be operably positioned within the interior of the mill housing through the open top thereof;

feed angle adjustment means associated with the mill housing and the top and bottom roll cradles for rotatively moving the roll cradles to establish a selected feed angle between the top and bottom rolls;

roll gorge adjustment means associated with the mill housing and the top and bottom roll cradles for vertically moving the roll cradles to establish a selected roll gorge spacing between the top and bottom rolls;

clamping means associated with the mill housing to fixedly secure said top and bottom roll cradles within the mill housing when the selected feed angle and roll spacing have been established;

guide shoe means positioned on opposed sides of the rolls to support a rotating workpiece along a pass line defined by said rolls; and bar support means attached to the mill housing on an exit end of said mill housing adapted to rotatably support a mandrel bar and pierced shell exiting said mill.

14. The mill of claim 13 wherein each of the guide shoe means includes a pivotal support arm mounted on the mill housing carrying a rotatable guide shoe holder at one end thereof, each guide shoe holder having first and second guide shoes detachably mounted at opposed ends thereof, each of said support arms adapted to pivotally move toward said pass line into an operable position, wherein the first of said guide shoes supports the workpiece and adapted to pivotally move away from said pass line in a maintenance position, whereby the guide shoe holder is rotated 180° to place the second guide shoe in an operable position facing the pass line and to permit replacement of the first guide shoe.

15. The mill of claim 13 wherein the top and bottom rolls are conical in shape.

16. The mill of claim 13 wherein the feed angle adjustment means includes a rotation bar affixed to each of the roll cradles, and respective pusher means to engage each of the rotation bars to permit selective rotation of each of the roll cradles and rolls about a vertical axis.

17. The mill of claim 16 wherein each of the respective pusher means includes a motorized jack screw stop and an opposed hydraulically actuated pusher bar, wherein the desired feed angle is determined by a position of the motorized jack screw stop and said hydraulically actuated pusher bar is adapted to move the rotation bar of the roll cradle to the position established by motorized jack screw stop.

18. The mill of claim 13 wherein the roll gorge adjustment means comprises bottom roll cradle height adjustment means and top roll cradle height adjustment means, said bottom roll cradle height adjustment means including a pair of spaced apart motorized mill jack screws positioned on a lower portion of the mill housing adapted to engage said bottom roll cradle and vertically move the said bottom roll cradle to a selected height, and further including a pair of hydraulically actuated bottom balancing cylinders to engage and assist in moving the bottom roll cradle;

said top roll cradle height adjustment means including a pair of motorized mill jack screws vertically moveable to a selected height for engagement with the top roll cradle to establish the roll spacing, and a plurality of hydraulically actuated top balance cylinders adapted to engage the top roll cradle and for lifting the top roll cradle to the selected height established by the mill jack screws.

19. The mill of claim 18 wherein the top roll cradle further includes a pair of cradle ledges radially extending on opposed sides of said top roll cradle adapted to engage the mill jack screws, and further including a plurality of outwardly extending cradle wings affixed at an upper end of said top roll cradle for engagement with the top balance cylinder.

20. The mill of claim 13 including top and bottom drive spindles for driving the top and bottom rolls, respectively, said mill further including a spindle manipulation device associated with each of the drive spindles, said spindle manipulation device including means for detachably gripping said respective spindle and means for moving said spindle in a vertical direction and in a horizontal direction toward and away from said mill to permit attachment and detachment of the respective drive spindles to the top and bottom rolls.

21. A vertical piercer/elongator mill for the manufacture of seamless tubing, comprising:

a mill housing having an open interior and an open top, defined by a plurality of vertically extending mill posts;

a bottom roll cradle having a bottom roll rotatably supported therein, said bottom roll cradle adapted to be operably positioned within the interior of the mill housing through the open top thereof;

a top roll cradle having a top roll rotatably supported therein, said top roll cradle adapted to be operably positioned within the interior of the mill housing through the open top thereof;

feed angle adjustment means associated with the mill housing and the top and bottom roll cradles for rotatively moving the roll cradles to establish a selected feed angle between the top and bottom rolls;

roll gorge adjustment means associated with the mill housing and the top and bottom roll cradles for vertically moving the roll cradles to establish a selected roll gorge spacing between the top and bottom rolls;

clamping means associated with the mill housing to fixedly secure said top and bottom roll cradles within the mill housing when the selected feed angle and roll spacing have been established;

guide shoe means positioned on opposed sides of the rolls to support a rotating workpiece along a pass line defined by said rolls;

bar support means attached to the mill housing on an exit end of said mill housing adapted to rotatably support a mandrel bar and pierced shell exiting said mill; and wherein the mill includes top and bottom drive spindles for driving the top and bottom rolls, respectively, said mill further including a spindle manipulation device associated with each of the drive spindles, said spindle manipulation device including means for detachably gripping said respective spindle and means for moving said spindle in a vertical direction and in a horizontal direction toward and away from said mill to permit attachment and detachment of the respective drive spindles to the top and bottom rolls.

* * * * *

UNITED STATES PATENT AND TRADEMARK OFFICE

CERTIFICATE OF CORRECTION

PATENT NO. : 5,295,379

DATED : March 22, 1994

INVENTOR(S) : Rudy M. Trbovich, William Rozmus and Mario Ricci

It is certified that error appears in the above-indentified patent and that said Letters Patent is hereby corrected as shown below:

Column 2, line 52, "crosssectional" should read --cross-sectional--.

Column 3, line 38, after "DETAILED DESCRIPTION", insert --OF THE INVENTION--.

Column 6, line 39, "cradle." should read --cradle--.

Column 9, line 30, claim 3, after "claim", insert --1--.

Signed and Sealed this

Thirteenth Day of September, 1994

*Attest:*

*Attesting Officer*

Bruce Lehman

BRUCE LEHMAN

*Commissioner of Patents and Trademarks*